US007705745B2

(12) United States Patent
Periot et al.

(10) Patent No.: US 7,705,745 B2
(45) Date of Patent: Apr. 27, 2010

(54) TRAFFIC SIGNAL COLUMN

(75) Inventors: Jean-Marie Periot, Rueil Malmaison (FR); Thierry Chue, Rueil Malmaison (FR); Didier Severac, Rueil Malmaison (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 521 days.

(21) Appl. No.: 11/578,145

(22) PCT Filed: Mar. 24, 2005

(86) PCT No.: PCT/EP2005/051384

§ 371 (c)(1),
(2), (4) Date: Aug. 28, 2007

(87) PCT Pub. No.: WO2005/108856

PCT Pub. Date: Nov. 17, 2005

(65) Prior Publication Data

US 2008/0150760 A1 Jun. 26, 2008

(30) Foreign Application Priority Data

Apr. 8, 2004 (FR) ..... 04 03715
Apr. 8, 2004 (FR) ..... 04 03729

(51) Int. Cl.
*G08B 3/00* (2006.01)

(52) U.S. Cl. ..... 340/691.1; 340/686.4; 340/693.5; 340/321; 340/332; 40/557; 40/558; 40/612; 362/551; 116/63 R; 116/63 P

(58) Field of Classification Search ..... 340/691.1, 340/686.4, 693.1, 693.5, 321, 332, 333; 40/557, 40/558, 612; 362/551, 559; 116/63 R, 63 P, 116/63 C, 63 T
See application file for complete search history.

(56) References Cited

U.S. PATENT DOCUMENTS 4,489,306 A * 12/1984 Scolari ..... 340/473
4,533,122 A * 8/1985 Bannister ..... 256/69

(Continued)

FOREIGN PATENT DOCUMENTS

DE 198 26 095 12/1999

(Continued)

*Primary Examiner*—Daryl Pope
(74) *Attorney, Agent, or Firm*—Oblon, Spivak, McClelland, Maier & Neustadt, L.L.P.

(57) ABSTRACT

An optical traffic signal column including stacked levels fixed to one another by rotation. The base of each level includes, distributed along its periphery, oblong passages and fixed connectors. The conductors include rods each having two ends angularly offset from one another, and including a common conducting rod and a stage-specific conducting rod. The connector rods are identical and respectively fix the bottom of a conducting rod of the relevant level and the top of the respective conducting rod of an adjacent level, the angular offset between the two fixing points corresponding to that of ends of the conducting rods. The conducting rods are mutually arranged and mounted to effect, from one level to the next level, an essentially identical angular position of the common conducting rods and an angular offset of the stage-specific conducting rods.

14 Claims, 4 Drawing Sheets

U.S. PATENT DOCUMENTS

| | | | | |
|---|---|---|---|---|
| 5,036,791 | A * | 8/1991 | Thurston | 116/63 C |
| 6,520,712 | B2 * | 2/2003 | Kulp et al. | 404/9 |
| 6,769,380 | B1 * | 8/2004 | Carvajalino et al. | 116/63 P |
| 7,370,602 | B2 * | 5/2008 | Greves | 116/63 P |

FOREIGN PATENT DOCUMENTS

| | | |
|---|---|---|
| DE | 100 41 202 | 3/2002 |
| EP | 0 913 625 | 5/1999 |
| EP | 1 239 214 | 9/2002 |
| EP | 1 460 332 | 9/2004 |
| FR | 2 128 998 | 10/1972 |
| FR | 2 517 021 | 5/1983 |
| WO | 95 28598 | 10/1995 |

* cited by examiner

FIG. 3
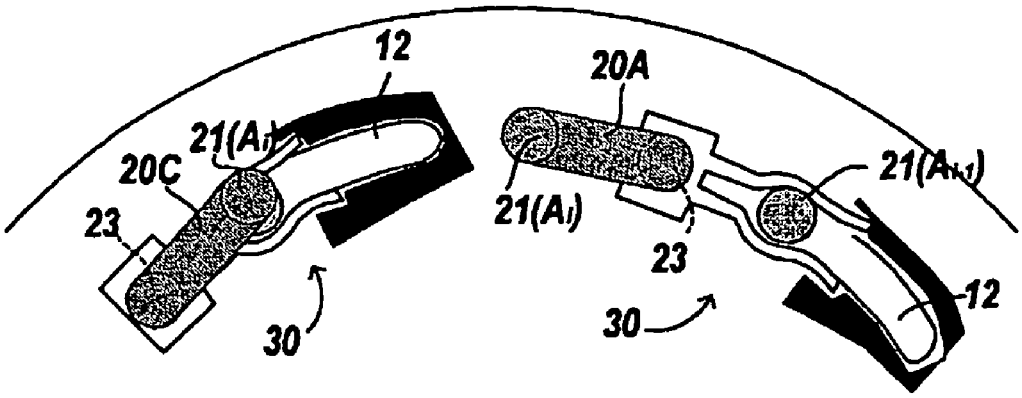
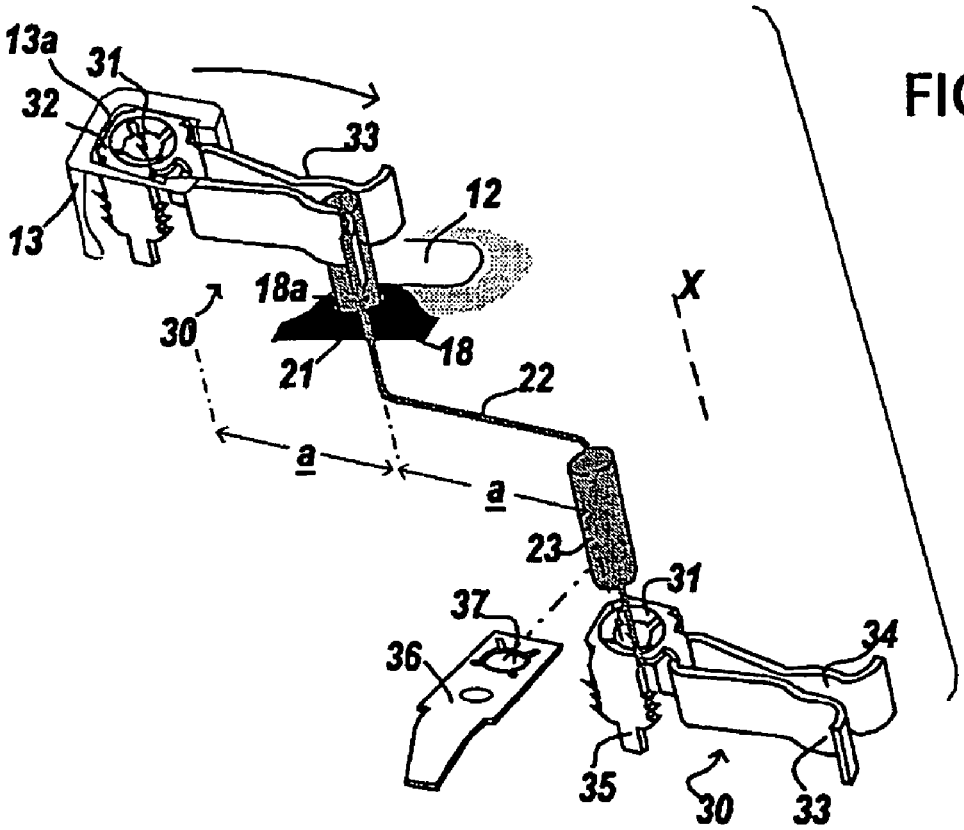
FIG. 4

TRAFFIC SIGNAL COLUMN

FIELD OF THE INVENTION

The present invention relates to a signal column composed of visual, audible or other-type signaling stages fastened in a stacked arrangement, the stages each having a body consisting of a base and of a side wall and conductors providing a connection between a power source and a signaling member housed in the body.

DISCUSSION OF THE BACKGROUND

Signal columns of this type are known from document FR 2 128 998. The supply conductors described in this document consist of blades comprising a first male connection end and a second female connection end. Homologous conductors situated in stacked stages are placed in series by introducing the male end of one into the female end of the other. The manufacture of such conductors entirely assuming the interconnection function is complicated. Furthermore, in these old columns each stage is supplied electrically by means of two specific conductors, this considerably multiplying the number of conductors at the base of the column.

Document EP 755 494 discloses a signal column in which the supply conductors are folded to form a U-shaped bridge at one end and an elbow at their other end. In this way homologous conductors situated in stacked stages are placed in series by elastic application of the elbow of the one with the U-shaped bridge of the homologous conductor of the other. However, this arrangement may result in contact faults because the connection quality is entirely assumed by the shape and elasticity of the conductors. Furthermore, as in the preceding document, each stage of the column is supplied by two conductors, yet the number of these conductors must be limited.

In order to limit the number of conductors, there is provided in each stage of the column a common conductor which, by connecting from stage to stage, extends from the lowermost stage to the uppermost stage, and, for each stage, an allocated conductor which originates from the lowermost stage and which does not have to be continued toward the immediately upper stage. The stage-to-stage connection is to this end brought about by means of an angular offset of the connecting points for the conductors, as is described in document FR 2 517 021. The disadvantage is that, if it is desired to give the various stages the same angular assembly position, use must be made of common conductors whose shape differs from that of the allocated conductors.

Document DE 100 41 202 describes a signal column having a number of stackable signaling elements. Each element is provided with a light source supplied from electrical conductors extending along its side wall. One conductor is common to all the signaling elements and supplies each of them. Another conductor is specific to the supply of each stage. Each conductor has a first end forming a junction bridge for an adjacent signaling element. The common conductor has the specific feature that it extends vertically along the column, whereas the conductors specific to each signaling element are offset angularly from one stage to the other. The junction bridge of the common conductor takes the form of a knot so that it can extend along this vertical axis. As in document FR 2 517 021, this document proposes using a conductor common to all the stages and specific conductors allocated to each of the stages. The proposed solution therefore makes it possible to limit the number of conductors. However, this solution requires the use of specific conductors whose shape differs from that of the specific conductors, this complicating the manufacturing method and increasing its cost.

SUMMARY OF THE INVENTION

The object of the invention is to provide a signal column which can be manufactured simply and inexpensively.

According to the invention, the signal column is composed of signaling stages, particularly visual signaling stages, which are mounted in a stacked arrangement along a main axis and fastened to one another by rotation, the stages each having a body which comprises a base and a cylindrical wall, and housing a signaling member and conductors which are distributed over the periphery of the body and which extend parallel to the axis so as to provide an electrical connection between a power source and the signaling member, the conductors housed in a stage being conducting rods, the rods housed in a stage comprising a common rod and at least one stage-specific rod. The column according to the invention has the following particular features:

- the common rods are identical to the other rods, and
- from one stage to the other, the common rods have a substantially identical angular positioning relative to one another and the specific rods have an angular offset with respect to one another.

According to one particular feature, the base has connectors and each connector comprises two fastening points for respectively fastening a first end of a rod of the stage in question and a second end of the respective rod of an adjacent stage.

According to another particular feature, the conducting rods each have two ends angularly offset from one another.

According to another particular feature, the two fastening points of the connector have an angular offset, this angular offset corresponding to that present between the two ends of a rod.

According to one specific embodiment, the conducting rods are in the form of a crank with straight ends, which are oriented along the main axis of the column so as to cooperate via a foot and a head with the respective connectors, and with an intermediate offsetting segment.

According to one particular feature, the common rod housed in a stage is arranged with a foot/head angular offset in the opposite direction to the foot/head angular offset of the other rods housed in the same stage. In this way the common rods exhibit identical angular positioning from one stage to the other.

According to another particular feature, the connectors are identical for the common rod and the other rods, and each connector extends, between the fastening point for the head of a rod from the lower stage and the fastening point for the foot of the rod of the stage in question, over a distance which is substantially equal to that of the offset between the foot and head of the rod. Thus, the connector can compensate for the angular offset between the two ends of a rod, thereby allowing the common rods to extend parallel to the axis of the column.

According to another particular feature, each connector has an element for fastening a first end of the conducting rod of the stage in question and an elastic clip for connecting a second end of the respective conducting rod of an adjacent stage.

According to another particular feature, the clip of each connector is oriented so as to be substantially tangential and open toward an oblong passage formed in the periphery of the base of the body.

According to another particular feature, the connectors are immobilized on the base.

According to another particular feature, each connector is fitted or snapped into an insulating stud molded in one piece with the base of the body.

According to another particular feature, the body of the stage has, at the opposite end from the base of the stage, a support provided at its periphery with fastening orifices for rigidly retaining the heads of the conducting rods particular to the stage.

According to another particular feature, there is provided in a stage two connection pieces intended for the signaling member particular to the stage, each connection piece having an opening for the passage of the foot of a respective conducting rod.

According to another particular feature, the foot of the conducting rod is fitted with contacting both in the fastening orifice formed in the connector and in the opening in the connection piece.

BRIEF DESCRIPTION OF THE DRAWINGS

The detailed description which follows with reference to the appended drawings illustrates an embodiment given by way of example.

FIG. 3 illustrates on an enlarged scale and in plan view two connectors and the associated rods.

FIG. 4 is an exploded view of the ends of a conductor and of the associated connectors.

DESCRIPTION OF PREFERRED EMBODIMENTS

Figure 1:
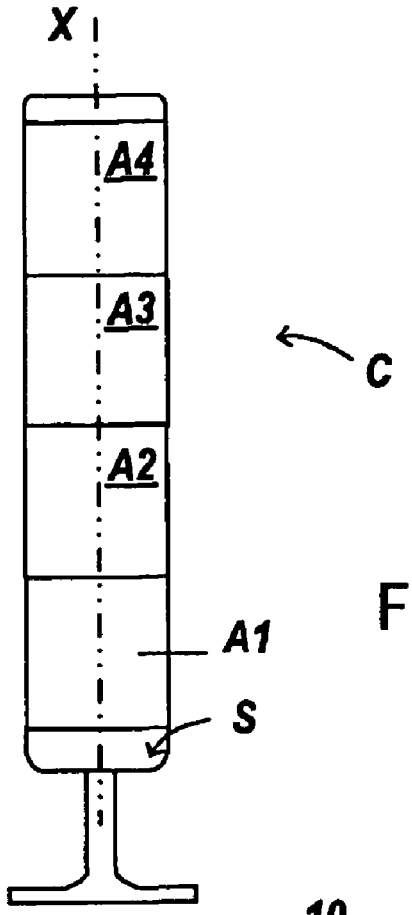
FIG. 1 illustrates a staged signal column in a side view.

The signal column C illustrated in the figures comprises a number of stacked signaling stages or modules A. As can be seen from FIG. 1, the column C extends along a vertical axis X and has four stages A1-A4 fastened to one another, the lowermost stage A1 being fastened to a pedestal S that ensures passage for the electrical conductors, the uppermost stage A4 being, for example, capped by a cover. The column may of course have a different number of stages.

Figure 2:
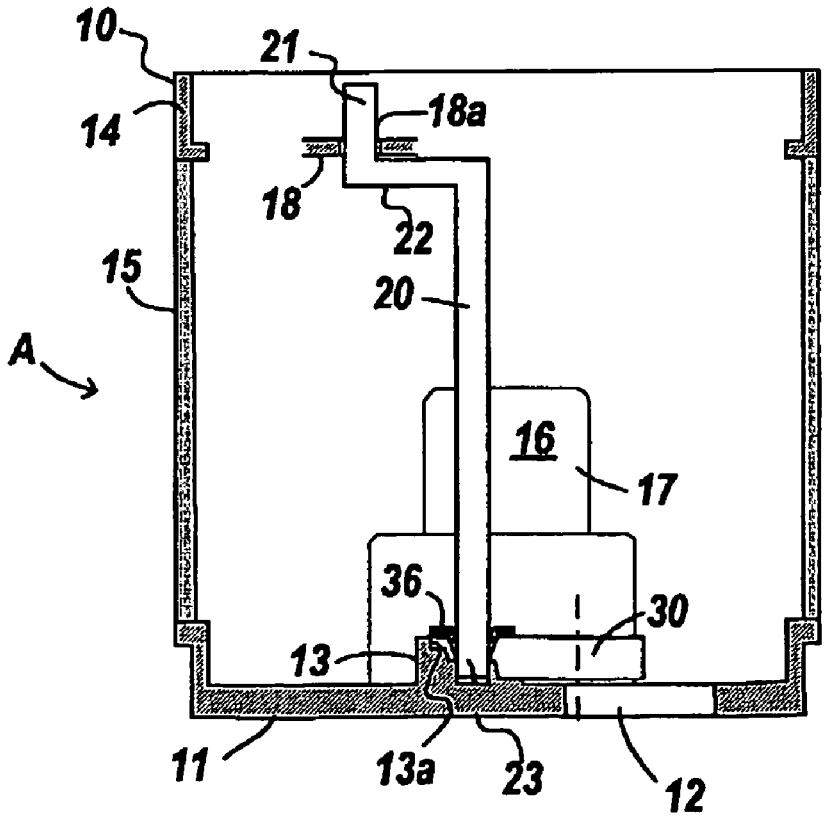
FIG. 2 schematically shows in enlarged axial section a stage of the column according to the invention.
Figure 5:
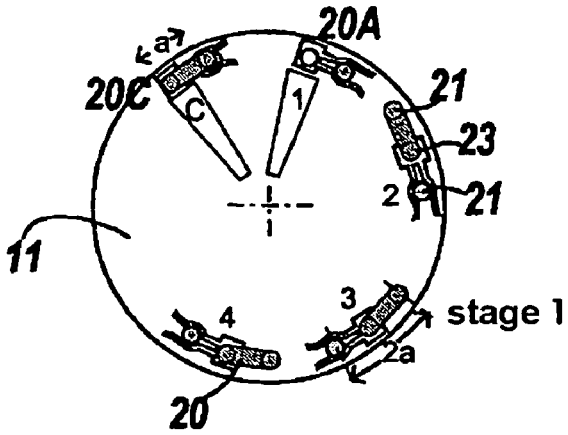
FIGS. 5 to 8 schematically show in plan view the connections made in the various stages of the column shown in FIG. 1.

The body 10 of a stage $A_i$ houses a number of conducting rods 20. For the sake of clarity, FIG. 2 shows a single rod of a stage $A_i$. The body 10, which is of cylindrical or prismatic shape with axis X, has a base 11 provided around its periphery (see FIGS. 3 and 5 to 8) with a number of curved passages 12 and with studs 13 adjacent to these passages and intended to receive connectors 30. At the opposite end from the base (that is to say towards the top in the figures), the body 10 has a support 14 such as a cap or a frame designed to seat the base of the body 10 of the upper stage $A_{i+1}$. The frame 14 has fastening tabs 18 each provided with a retaining orifice 18*a* for the upper end of a respective rod 20 of the stage $A_i$.

The base 11 has at its center a signaling member 16 placed or fastened on a mount 17. The member has to be supplied from two rods 20, one being a rod 20A allocated to the member 16 of the stage $A_i$, the other being a common rod 20C for connecting to the member 16 of each stage. It follows that the "allocated" rod 20A is not connected to the following (upper) stage $A_{i+1}$, whereas the common rod 20C is connected to the following stage, the same applying to the rods 20A allocated to the upper stages. A stage $A_{i+1}$ is fastened to an underlying stage $A_i$ by a limited rotation about the axis X, using guide, stop and locking arrangements which do not form part of the invention and are not represented here.

In more detail, each rod 20 is in the form of a crank and comprises an upper part terminated by a head 21, an intermediate segment 22 determining an angular offset about the axis X, and a lower part terminated by a foot 23. The angular offset—or the corresponding peripheral distance—is illustrated as a in FIGS. 4 and 5. The upper and lower parts of the rod are straight and extend along the axis X, whereas the intermediate segment 22 extends substantially horizontally and tangentially so as to determine the desired angular offset between the foot and the head. The head 21 is fastened in a retaining orifice 18*a* formed in the tab 18 of the frame 14 of the element A, whereas the foot 23 is engaged and retained in the connector 30 situated at the bottom of the body 10 of the element $A_i$. Moreover, the head 21 is presented to an associated connector 30 which belongs to the overlying stage $A_{i+1}$ so as to be retained in this connector (see FIG. 4). In a variant, the positioning of the head and of the foot in the connectors may of course be inverted at the same time as the function performed by the base 11 and the support 14.

It should be noted that, according to the invention, the common rods 20C are identical to the allocated rods 20A. However, whereas the allocated rods 20A in a stage are all arranged in the same direction (for example head 21 offset in the counterclockwise direction with respect to the foot 23), the common rod 20C is arranged in the opposite direction (for example head 21 offset in the clockwise direction with respect to the foot 23). This can be seen in FIGS. 3 and 5 to 8.

The connector 30 is a conducting metal part which is folded so as to fasten both the foot 23 of a rod of the current stage and, in a detachable manner, the head 21 of the associated rod of the lower stage. The connector has a fastening socket 31 for the foot 23 of the associated rod, this socket being obtained for example by cutting out a mounting pad 32. The connector 30 opens toward the passage 12 of the elastic branches of a clip 33 forming a housing 34 for a head 21 emerging from the lower stage. Each connector is fitted or snapped into a stud 13 or housing of the base 11 and it is held in position by fastening tabs 35 engaged in holes in the base.

As can be seen from the figures, the length of the connector—seen between the housing for the head and the orifice for fastening the foot—is substantially equal to, or of the same order as, the length a of the offsetting segment 22 of the rod 20. In other words, it is possible, when assembling the stage $A_{i+1}$ on the stage $A_i$ by pivoting, for this offset to be taken up peripherally. The heads 21 of the common rods 20C of the various stages are therefore in the same angular position. The heads 21 of the "allocated" rods are by contrast mutually offset from stage to stage by an angle corresponding to 2*a*.

For the purpose of supplying the member 16 of the stage $A_i$ (see FIGS. 5 to 8), there is provided in the body 10 of the stage two connection pieces 36 which extend substantially radially between a connector 30 and a respective terminal of the member 16. Preferably, the piece 36 simply consists of a contact blade provided with an orifice 37. The foot 23 of the associated rod passes through this orifice 37 with contacting between the rod and connection piece. The piece is thus positioned on the cut-out socket 31 of the connector 30 which houses the foot 23. It is additionally held in place by being force-fitted into a lug 19 of the base 11 (see FIG. 9).

It should be pointed out that the two connection pieces 36A, 36C (see FIGS. 5 to 8) particular to a stage are respectively connected to a rod 20A allocated to the stage and to a common rod 20C. Thus, the stage A1 (FIG. 5) has one common connector and four other connectors (one for A1 and the other three for A2, A3, A4), the stage A2 has one common connector and three other connectors (one for A2 and the other two for A3, A4), the stage A3 has one common connector and two connectors (for A3 and A4), the stage A4 has one common connector and one designated connector. The connectors associated with the rods 20A, 20C are all identical.

The elements of the column described are fitted in the following way. The connectors 30 are introduced into their respective studs 13, are fastened via their tabs 35, then the two connection pieces 36A, 36C of the stage are centered on the pad 32 of the respective connectors 30A, 30C. The feet 23 of the rods 20 are then inserted with force into the sockets 31 to make contact with the connectors, whereas the heads 21 are fitted into the orifices 18*a* in the tabs 18 to provide reliable positioning. The upper stage $A_{i+1}$ is placed by its base 11 on the frame 14 of the stage $A_i$ in such a way that the head 21 of the rods 20 is engaged in the respective passage 12 without entering the clip 33. The upper stage is then rotated about the axis X (horizontal arrow in FIG. 2) so that the heads 21 advance into the respective passages 12 until they enter the clips 33. On completion of the rotation, each head 21 is maintained in its housing 34, with the result that the desired connection between the poles of $A_i$ and the corresponding poles of $A_{i+1}$ is ensured. Since the common rod 20C is offset tangentially in the opposite manner to the other rods 20A, and since the length of the connector 30 is equal to the tangential offset a provided by the segment 22 of the rod, the head 21 of the rod 20C of the stage $A_i$ is in the same angular position as the head 21 of the rod 20C of the stage $A_{i-1}$. By contrast, the head of a rod 20A of $A_i$ is advanced in the counterclockwise direction by 2*a* with respect to the head of the corresponding rod 20A of $A_{i-1}$.

Figure 6:
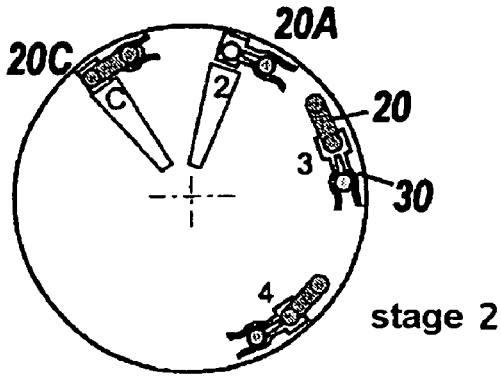
Figure 7:
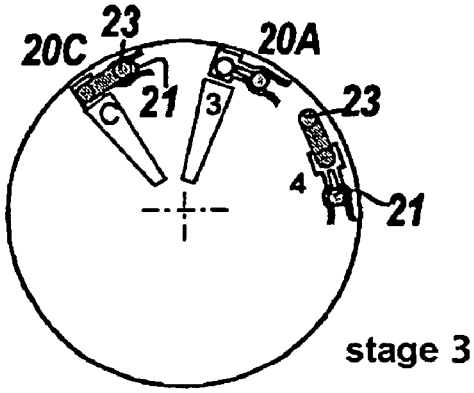
Figure 8:
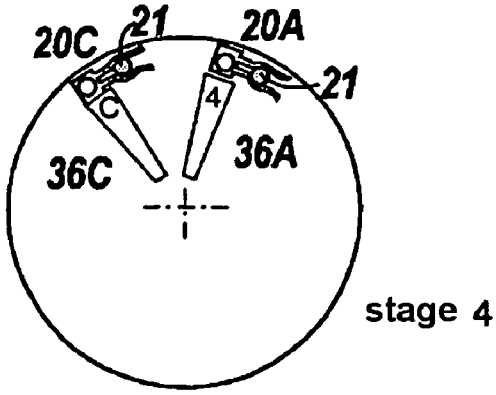
Figure 9:
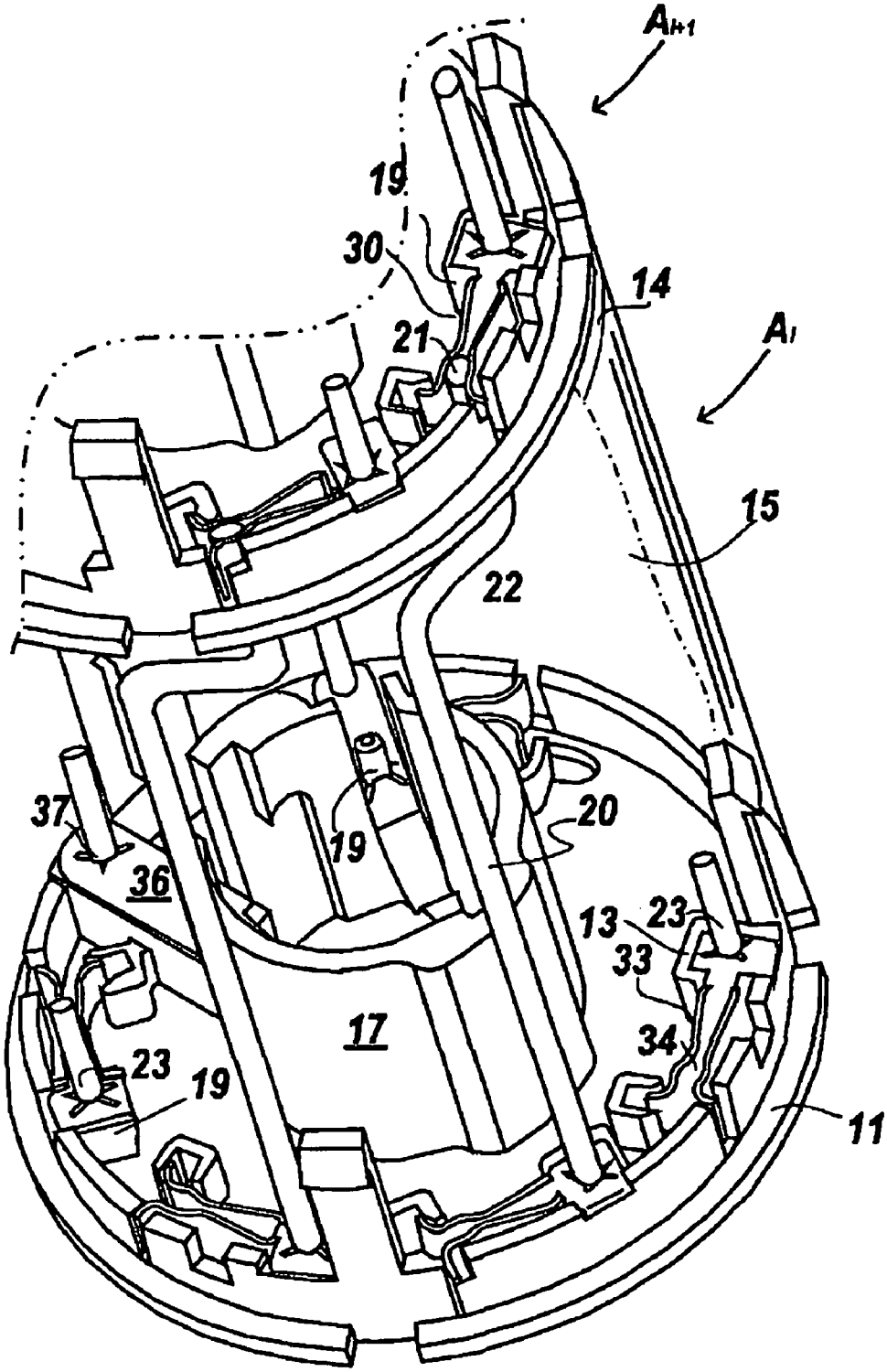
FIG. 9 is a partial perspective view of two interconnected stages.

FIGS. 6 to 8 show that the rod allocated to stage $A_{i-1}$ is not continued into the stage $A_i$, so that the heads 21 of the rods that have been continued have advanced by a step 2*a*.

The invention claimed is:

1. A signal column comprising:

signaling stages mounted in a stacked arrangement along a main axis and fastened to one another by rotation, the signaling stages each including a body that includes a base and a cylindrical wall, and housing a signaling member and conductors distributed over a periphery of the body and that extend parallel to the main axis to provide an electrical connection between a power source and the signaling member, the conductors housed in the respective stages including conducting rods, the conducting rods housed in each stage comprising a common rod to connect to an adjacent following signaling stage and at least one stage-specific rod not connected to an adjacent following signaling stage, wherein the common rods are identical in shape to the stage-specific rods, and from one signaling stage to an adjacent following signaling stage, the common rods have a substantially identical angular positioning relative to one another and the stage-specific rods have an angular offset with respect to one another.

2. The signal column as claimed in claim 1, wherein the base includes connectors and each connector includes two fastening points for respectively fastening a first end of a conducting rod of the signaling stage in question and a second end of the respective conducting rod of an adjacent following signaling stage.

3. The signal column as claimed in claim 2, wherein the conducting rods each include two ends angularly offset from one another.

4. The signal column as claimed in claim 3, wherein the two fastening points of the connector have an angular offset corresponding to that present between the two ends of a rod.

5. The signal column as claimed in claim 2, wherein the conducting rods are in a form of a crank with straight ends, oriented along the main axis of the column so as to cooperate via a foot and a head with the respective connectors, and with an intermediate offsetting segment.

6. The signal column as claimed in claim 5, wherein the common rod housed in a respective signaling stage is arranged with a foot/head angular offset in the opposite direction to the foot/head angular offset of the at least one stage-specific rod housed in the same signaling stage.

7. The signal column as claimed in claim 5, wherein the connectors are identical for the common rod and the at least one stage-specific rod, and each connector extends, between the fastening point for the head of a conducting rod from a lower signaling stage and the fastening point for the foot of the conducting rod of the signaling stage in question, over a distance substantially equal to that of the offset between the foot and head of the rod.

8. The column as claimed in claim 3, wherein each connector includes an element for fastening a first end the conducting rod of the signaling stage in question and an elastic clip for connecting a second end of the respective conducting rod of an adjacent signaling stage.

9. The signal column as claimed in claim 8, wherein the clip of each connector is oriented so as to be substantially tangential and open toward an oblong passage formed in the periphery of the base of the body.

10. The signal column as claimed in claim 3, wherein the connectors are immobilized on the base.

11. The signal column as claimed in claim 10, wherein each connector is fitted or snapped into an insulating stud molded in one piece with the base of the body.

12. The signal column as claimed in claim 5, wherein the body of the stage includes, at the opposite end from the base of the stage, a support provided at its periphery with fastening orifices for rigidly retaining the heads of the conducting rods particular to the signaling stage.

13. The signal column as claimed in claim 12, further comprising in each signaling stage two connection pieces for the signaling member particular to the signaling stage, each connection piece including an opening for passage of the foot of a respective conducting rod.

14. The signal column as claimed in claim 13, wherein the foot of the conducting rod includes a contacting both in the fastening orifice formed in the connector and in the opening in the connection piece.

* * * * *